US005836257A

United States Patent [19]

Belin et al.

[11] Patent Number: 5,836,257

[45] Date of Patent: Nov. 17, 1998

[54] CIRCULATING FLUIDIZED BED FURNACE/ REACTOR WITH AN INTEGRAL SECONDARY AIR PLENUM

[75] Inventors: Felix Belin, Brecksville; David J. Walker, Wadsworth, both of Ohio

[73] Assignee: McDermott Technology, Inc., New Orleans, La.

[21] Appl. No.: 759,885

[22] Filed: Dec. 3, 1996

[51] Int. Cl.[6] ..... F23G 5/00

[52] U.S. Cl. ..... 110/245; 110/234; 122/4 D; 165/104.16; 422/142

[58] Field of Search ..... 110/245, 251, 110/234, 348, 182.5, 337, 263; 422/142, 146, 147; 165/104.16; 122/4 D

[56] References Cited

U.S. PATENT DOCUMENTS 4,330,502 5/1982 Engstrom ..... 422/142

*Primary Examiner*—Henry A. Bennett
*Assistant Examiner*—Susanne C. Tinker
*Attorney, Agent, or Firm*—Robert J. Edwards; Eric Marich

[57] ABSTRACT

A circulating fluidized bed processor has a processor enclosure at least partially defined by a front wall and a rear wall spaced away from the front wall. A bottom wall is connected between the front and rear walls and a mechanism is provided for supplying primary air through the bottom wall for fluidizing a circulating bed in the enclosure. Another mechanism is provided for recirculating the bed from a top of the enclosure back to the enclosure. One or more secondary air plenum(s) are provided in the enclosure between the front and rear walls for supplying secondary air into the fluidized bed, above the bottom wall, so that secondary air reaches deep into the enclosure. The plenum(s) are formed of a waterwall which has a plurality of openings therein to allow communication of gases and solids therethrough from one side of the waterwall to the other.

9 Claims, 8 Drawing Sheets

CIRCULATING FLUIDIZED BED FURNACE/ REACTOR WITH AN INTEGRAL SECONDARY AIR PLENUM

FIELD OF THE INVENTION

The present invention relates, in general, to furnace constructions for circulating fluidized bed (CFB) boilers, reactors, or combustors and, in particular, to a new furnace construction for same which provides an enhanced ability to introduce secondary combustion air into the centermost portions of the CFB furnace. This is accomplished by providing one or more integral secondary air plenums which extend into the furnace near the center of the fluidized bed for insuring that secondary air penetrates deep into all portions of the bed. Advantageously, the integral secondary air plenum(s) are constructed of furnace waterwall tubes bent to create the one or more plenum structure(s).

BACKGROUND OF THE INVENTION

As CFB boilers, reactors, or combustors (hereinafter CFB reactors) become progressively larger, several issues arise which are related to scaling up the physical size of the furnace or reactor enclosure.

In CFB reactors, it is common to stage the combustion process to reduce $NO_x$ emissions. This is done by injecting a portion of the combustion air, called the primary air, into the bottom of the furnace reactor enclosure where combustion begins. The remaining amount of combustion air, called secondary or overfire air, is then injected into the furnace reactor enclosure at higher elevations to provide the balance of the air needed for complete combustion. On physically larger CFB reactors, one of the more significant scale-up issues involves maintaining the ability to inject the secondary, or overfire air above the lower or primary combustion (reaction) zone. The problem arises because as furnace depth increases, the ability of the secondary air to penetrate into the center of the furnace reactor enclosure is limited to a practical maximum dimension on the order of 15 to 20 feet by the jet size and the velocity required to enable the air to penetrate into the fluidized bed all the way into the center of the furnace.

Others have approached this problem by dividing the lower furnace into two sections, forming a so-called pant-leg configuration. This arrangement provides two sections, each of a reduced furnace depth which permits adequate penetration of secondary air since the total effective furnace depth is reduced approximately by a factor of two. The disadvantages of this approach include the physical separation of the fluidized solids in one side (one pant leg) of the furnace from the solids in the other side (the other pant leg) of the furnace, making uniform combustion and temperature control more difficult.

U.S. Pat. No. 5,343,830 to Alexander et al. and assigned to The Babcock & Wilcox Company, discloses a circulating fluidized bed reactor with multiple secondary or overfire air inlets into the combustion space. This patent is hereby incorporated by reference as though fully set forth herein, since it discloses various known elements in a CFB furnace or reactor.

U.S. Pat. No. 3,921,590 to Mitchell et al. discloses a divided fluidized bed combustor with a communicating passage between the two portions of the fluidized bed.

U.S. Pat. No. 4,517,162 to Moss discloses a fluidized bed reactor where the bed is divided into multiple sections using solid walls with no perforations therein. Also see U.S. Pat. No. 4,917,028 to Ganster et al. Examples of circulating fluidized beds with divided bed areas can also be found in U.S. Pat. Nos. 4,938,170 and 5,138,982 to Oshita et al. A fluidized bed reactor using a baffle system is disclosed in U.S. Pat. No. 5,218,932 to Abdulally.

SUMMARY OF THE INVENTION

A fundamental aspect of the present invention involves a furnace construction for a CFB reactor wherein one or more integral secondary air plenums are provided and which extend into the furnace near the center of the fluidized bed for insuring that secondary air penetrates deep into all portions of the bed. Advantageously, the integral secondary air plenum(s) are constructed of furnace waterwall tubes bent to create the one or more plenum structure(s). The waterwall tubes may be made of individual tubes or preassembled into waterwall membrane tube panels forming an open channel or plenum extending from side to side of the furnace reactor enclosure. The panels may form a plenum having a diamond shaped, oval, rectangular, circular or other shape as required to provide sufficient open area for the secondary air flow to be distributed to secondary air nozzles located across the width of the furnace reactor enclosure, and preferably in two opposing directions so as to penetrate towards both the front wall and rear wall of the single furnace reactor enclosure. The plenum membrane walls themselves are comprised of individual tubes, intermittent membrane walls (panels), or even a single membrane wall tube panel having openings therethrough for good communication of gases and solids between the front and rear portions of the furnace reactor enclosure. The intent is to maintain the furnace reactor enclosure's behavior as a single furnace region, but with enhanced secondary air introduction capability. Sufficient waterwall circuitry is provided to fluidically interconnect the tubes forming the secondary air plenum(s) with the balance of the water/steam circuitry in the CFB, and one or more headers may be provided at one or both of the bottom and top of each integral secondary plenum as required to provide for such fluidic interconnection. Openings are provided both above and below the one or more secondary air plenums to allow for good communication of solids throughout the furnace reactor enclosure.

Accordingly, one aspect of the present invention is drawn to a circulating fluidized bed reactor which includes a secondary air plenum arrangement between outer walls of the reactor to effectively distribute secondary air across the width of the furnace/reactor enclosure, without requiring excessively large nozzles, high velocities or extraordinary means for reaching central portions of the fluidized bed. For the purpose of this disclosure, the term CFB reactor will be used for brevity but it is understood that the term includes CFB reactors, combustors, or boilers. Particularly, the present invention is particularly suited to boilers or steam generators which employ CFB combustors as the means by which heat is produced. However, the term also encompasses devises wherein the CFB reactor enclosure is employed for chemical reactions other than combustion processes, or where a gas/solids mixture from a combustion process occurring elsewhere is provided to the reactor enclosure for further processing, or where the reactor merely provides an enclosure wherein particles or solids are entrained in a gas that is not necessarily a byproduct of a combustion process. Thus the term CFB reactor includes both CFB combustors and CFB reactors for various processes including chemical and physical processes.

Another aspect of the present invention is to provide a circulating fluidized bed reactor comprising a reactor enclosure at least partially defined by a front wall and a rear wall spaced away from the front wall, a bottom wall connected between the front and rear walls, means for supplying primary air through the bottom wall for fluidizing a circulating bed in the enclosure, and means for recirculating the bed material from a top of the enclosure back to a lower portion of the reactor enclosure. Secondary air plenum means are provided in the enclosure between the front and rear walls for supplying secondary air into the fluidized bed, above the bottom wall.

Yet another aspect of the present invention is to supply secondary air both through the front and rear walls and into the plenum either from front or back walls of the enclosure, or from the bottom of the reactor enclosure.

A still further aspect of the invention is to make the means for forming the plenum out of waterwall tubes in which are provided openings for allowing gas and fluidized bed material to pass from one side of the enclosure to the other side of the enclosure, through the waterwall.

Yet a still further aspect of the present invention is to provide a CFB reactor which includes one or more substantially centrally located secondary air plenum(s) and which is simple in design, rugged in construction and economical to manufacture.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which a preferred embodiment of the invention is illustrated.

DESCRIPTION OF THE PREFERRED EMBODIMENTS

Figure 1:
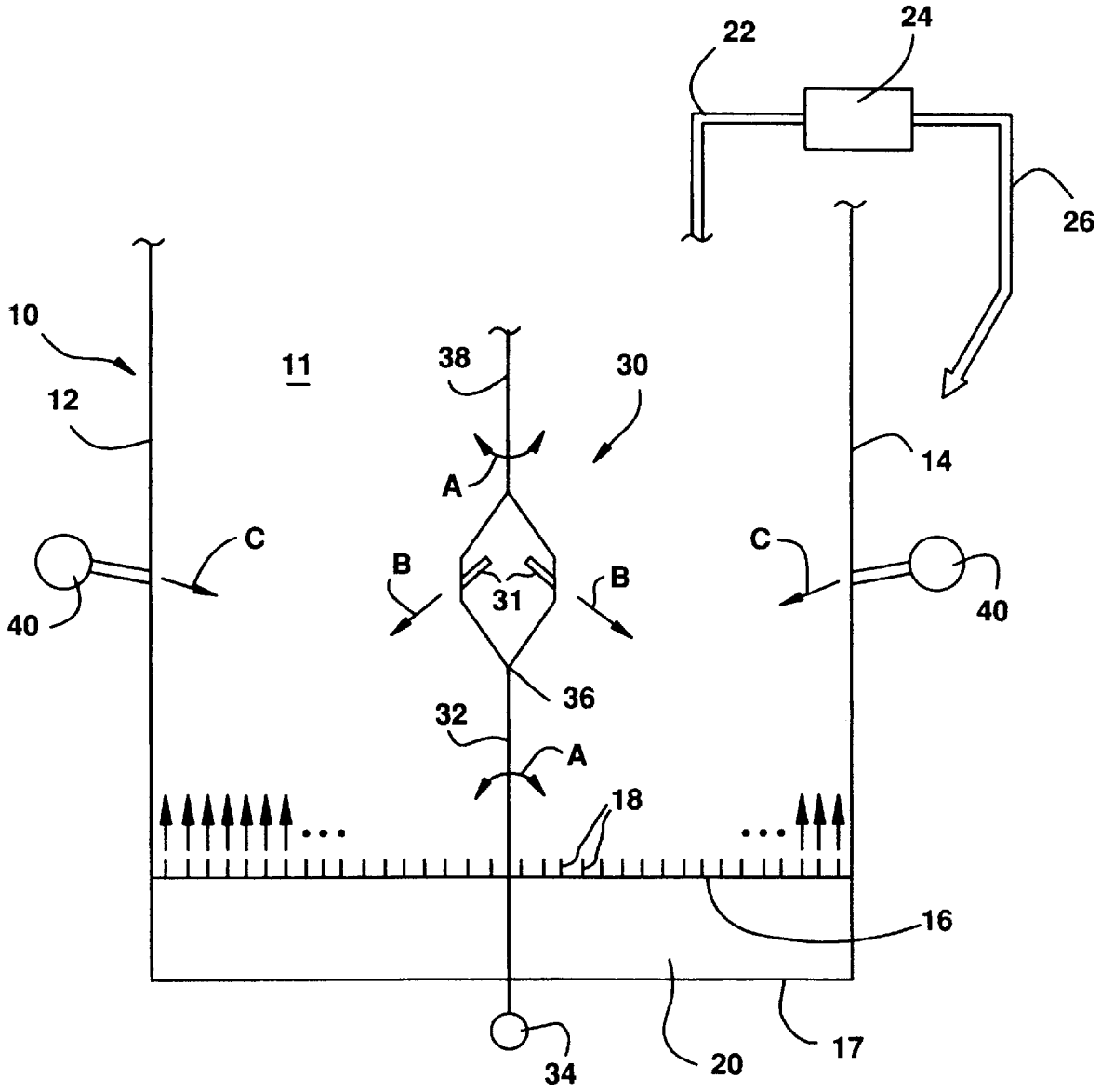
FIG. 1 is a schematic side sectional view of a circulating fluidized bed reactor according to a first embodiment of the present invention.

Referring to the drawings generally, wherein like reference numerals represent the same or functionally similar elements throughout the several drawings, and to FIG. 1 in particular, the invention embodied in FIG. 1 comprises a circulating fluidized bed (CFB) reactor generally designated 10, having a furnace reactor enclosure 11 having a front wall 12 made of waterwall, and a rear wall 14, also of waterwall. Waterwall or membrane wall is the known construction of tubes and filler pieces for combustors or boilers that act both to enclose a space and as a heat exchanger mechanism for drawing heat from the space. While the furnace reactor enclosure walls are typically waterwall surface construction, other constructions such as a refractory, non-fluidically-cooled arrangement could be employed for the outer front, rear and side walls. Furnace reactor enclosure 11 also includes a bottom wall 16 which contains a multiplicity of nozzles 18 for injecting primary combustion and fluidizing air into the bottom of the furnace reactor enclosure 11 from a windbox 20 defined below the bottom wall 16. Particle recirculation means in the form of a recirculation conduit 22 and additional mechanisms such as separators and the like and schematically illustrated at 24, are connected at the top of the furnace reactor enclosure 11 and to a return line 26 for returning at least some of the solid material from the top of the furnace reactor enclosure 11, which conveys the gases and solids comprising the circulating fluidized bed, back to a lower location in the furnace reactor enclosure 11, thus producing a circulating fluidized bed (CFB) arrangement.

In FIGS. 1–3, 5, and 8–10, the left hand side of each Fig. is considered to be the front wall, the right hand side is considered to be the rear wall, and the side walls lie in the plane of the Figs.

The present invention provides one or more plenums 30 for secondary air substantially along the center of the furnace reactor enclosure 11 and integral thereto without dividing the furnace reactor enclosure 11 physically into two separate sections. The plenum 30 is preferably made up of membrane tube panels 32 forming an open channel or plenum from side to side of the furnace reactor enclosure 11. The panels may form a plenum 30 having a diamond shaped, square, rectangular, oval, elliptical, or circular or other shape in cross-section as required, with sufficient open area for the secondary air to flow therethrough and be distributed therealong to the secondary air nozzles 31, fluidically connected to each of the plenums 30 and provided across the width of the furnace reactor enclosure 11, and in two opposing directions so as to penetrate toward both the front wall 12 and toward the rear wall 14 of the single furnace reactor enclosure 11. In all the Figs., secondary air is supplied at arrows B by the plenum 30 and at the front and rear walls 12, 14, by headers 40, at arrows C.

The tubes forming the plenum membrane walls 32 are fed by either individual tubes, intermittent membrane walls (panels), or a single membrane panel having a plurality of openings for good communication of gases and solids between the front and rear portions of the furnace reactor enclosure 11. This waterwall circuitry connects an inlet or supply header 34 located beneath the furnace floor 17 with the bottom, or lower portion 36, of the plenum 30.

The outlet membrane tubes 38, after forming the plenum 30, may again comprise individual tubes, intermittent membrane walls (panels), or a single membrane panel having a plurality of openings for good communication of gases and solids between the front and rear portions of the furnace reactor enclosure 11. Arrows A schematically show this gases and solids fluidic communication from one side of these membrane wall tubes to the other side. This membrane wall circuitry connects the top, or upper portion of the plenum 30 with an outlet header or headers (not shown)

above the furnace roof (also not shown). By this means, the secondary air plenum(s) are comprised of fluid-cooled structures able to withstand the high temperature environment within the furnace reactor enclosure 11, and the plurality of openings through this wall (between these tubes) provides good communication or movement of solids between the front and rear portions of the furnace reactor enclosure 11 at both lower and upper portions thereof.

By the means of the present invention, the penetration of secondary air is enhanced by splitting the distance required for air to penetrate across the furnace depth to approximately half the total furnace depth, but without separating the lower furnace (or upper furnace) portions of the furnace reactor enclosure 11 physically into two portions. In effect this invention allows the furnace depth to be doubled with effective secondary air penetration without violation of sound engineering practice as regards air nozzle size and air jet velocity, while effectively maintaining a single fluidized bed for good control of combustion and other operating parameters.

Figure 2:
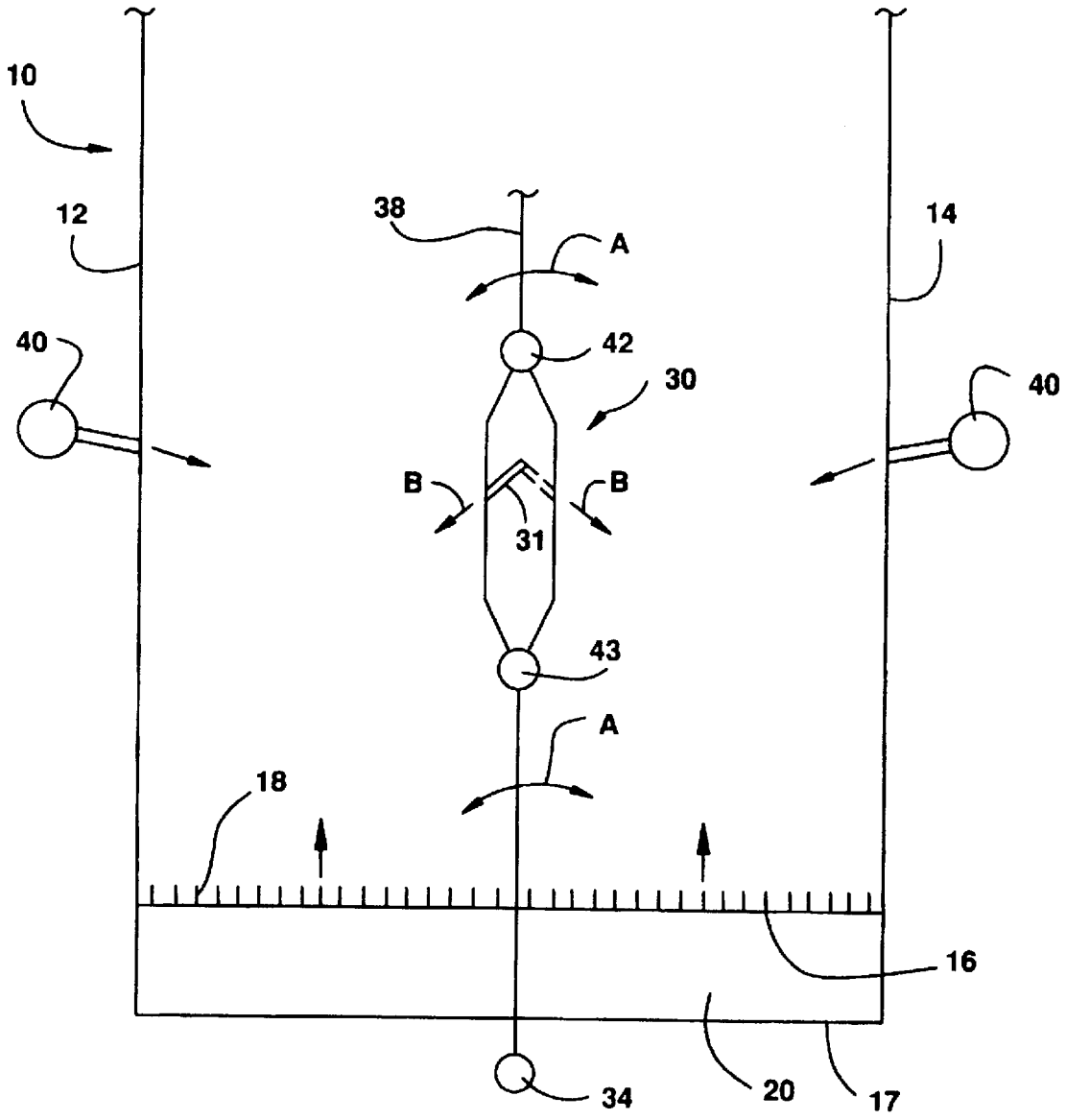
FIG. 2 is a schematic sectional side view similar to FIG. 1 of another embodiment of the invention.

FIG. 2 illustrates an alternate plenum 30 configuration; the plenum 30 here is of an elongated diamond shape, and may be provided with inlet and outlet headers at 42 and 43. It is understood that header 42 may be provided without header 43, or vice versa, and in certain installations both headers 42 and 43 might be utilized. This could facilitate different spacing of tubes either above or below the plenum (s) 30.

Figure 3:
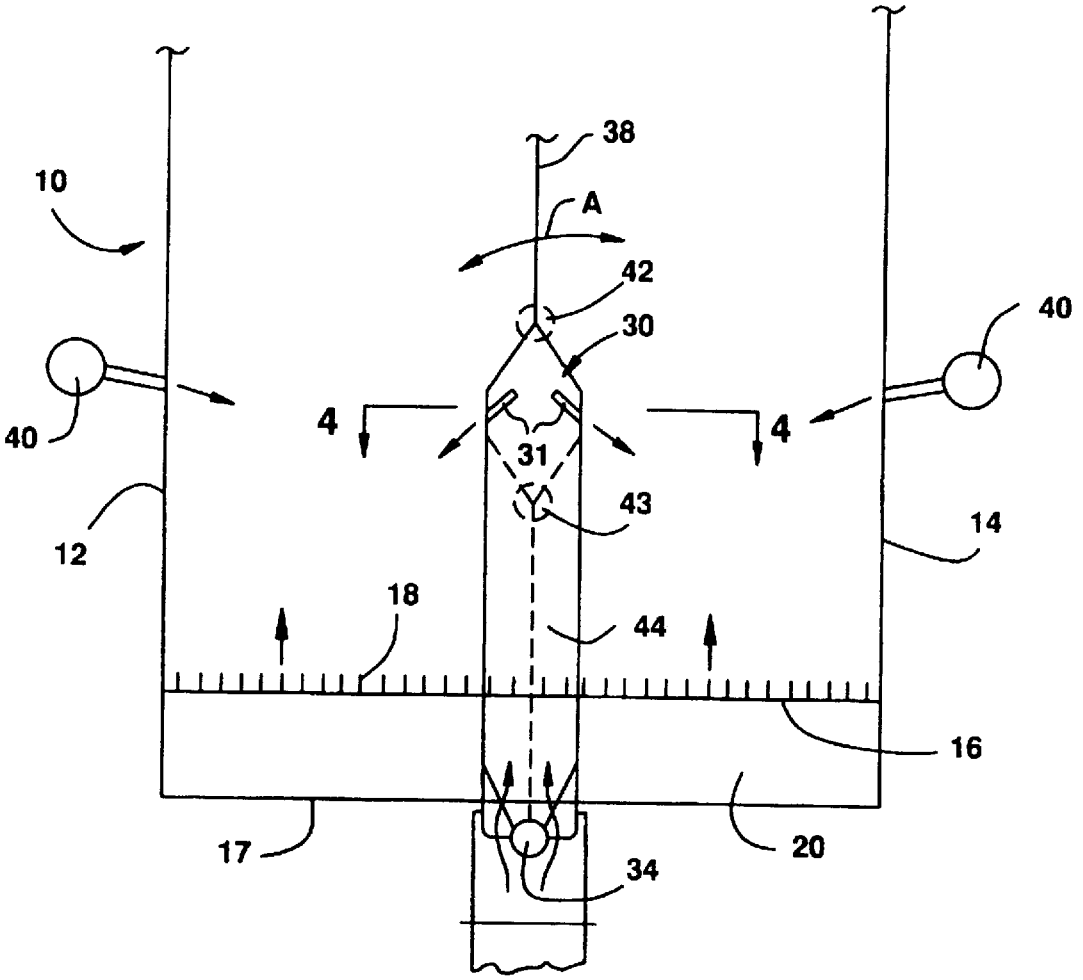
FIG. 3 is a schematic sectional side view similar to FIG. I of a still further embodiment of the invention.
Figure 4:
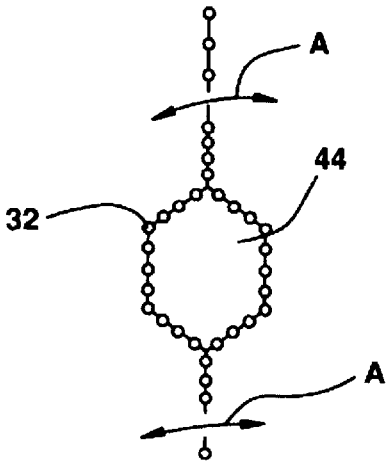
FIG. 4 is a vertical sectional plan view of a portion of the intermediate air feed ducts feeding the secondary air plenum taken along line 4—4 of FIG. 3.

In the basic invention of FIG. 1, the secondary air is fed into the integral plenum 30 from the ends of the plenum 30. In wider furnaces, the length of such a plenum 30 may increase beyond a desirable size to maintain air velocities along and through the plenum 30 as needed to provide good air distribution to the nozzles 31 positioned across the width of the CFB reactor 10. By means of special membrane wall circuitry as shown in FIGS. 3 and 4, (and FIGS. 5–7, discussed infra) intermediate air feed ducts 44 also made of fluid cooled tubes would be placed at intervals across the width of the furnace reactor enclosure 11. This additional embodiment allows the secondary air velocity in the plenum 30 to be maintained at reasonable values for good air distribution with a plenum 30 having a cross sectional air flow area smaller than if the plenum 30 air were fed only from the ends. That is, by adding intermediate air feed ducts 44 as required, the plenum 30 cross sectional air flow area and shape can be kept constant for all width furnaces, while maintaining good secondary air distribution, and leads to standardization of plenum 30 designs.

Figure 5:
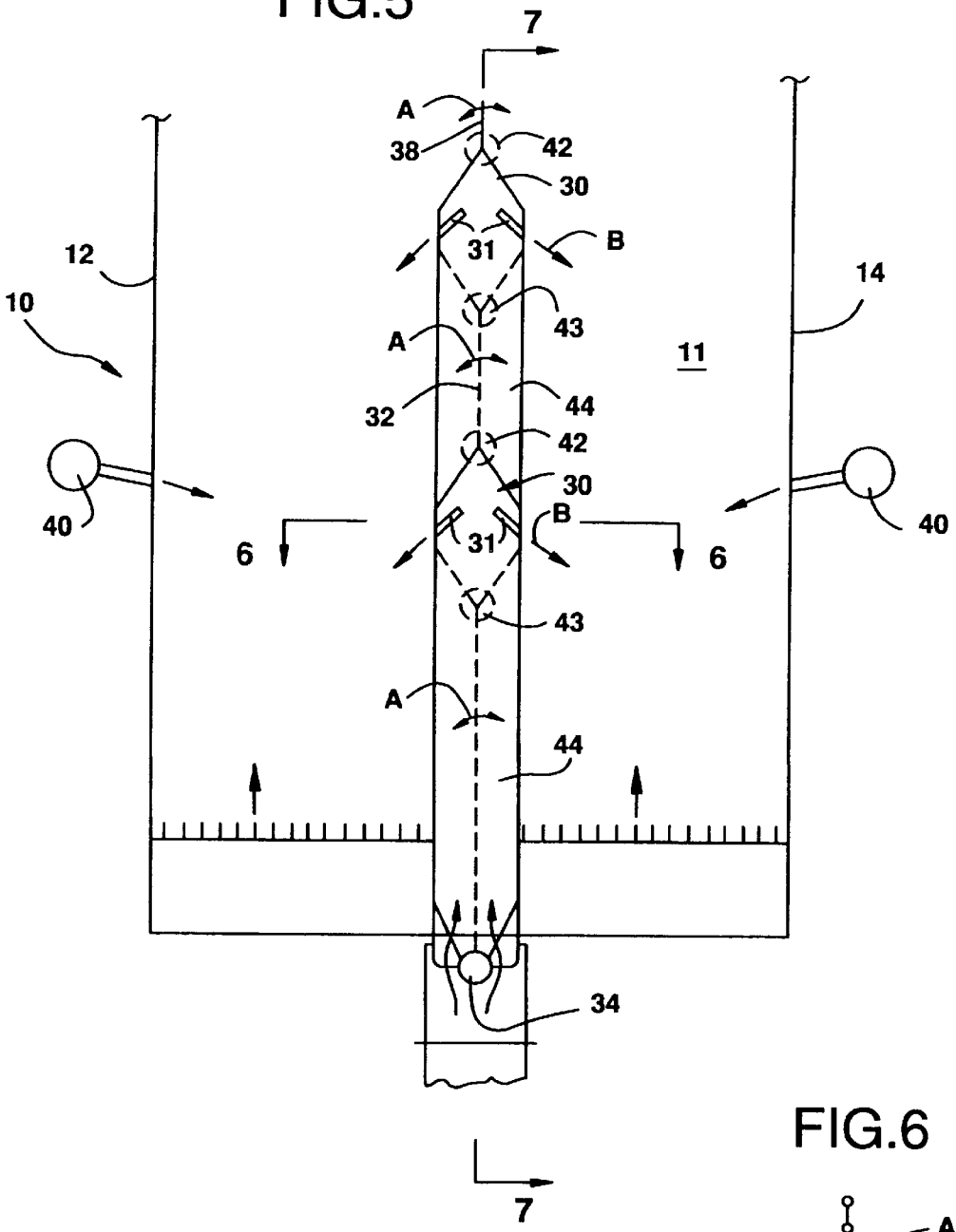
FIG. 5 is a schematic sectional side view similar to FIG. 1 of a still further embodiment of the invention, wherein plural secondary air plenums are employed.
Figure 6:
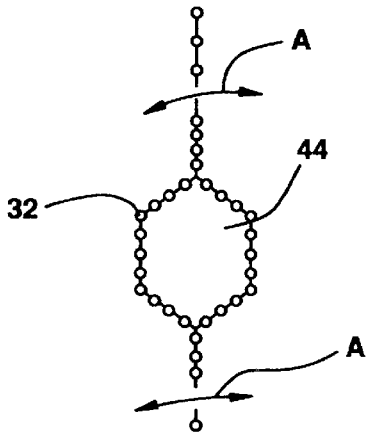
FIG. 6 is a vertical sectional plan view of a portion of the intermediate air feed ducts feeding the secondary air plenums taken along line 6—6 of FIG. 5.
Figure 7:
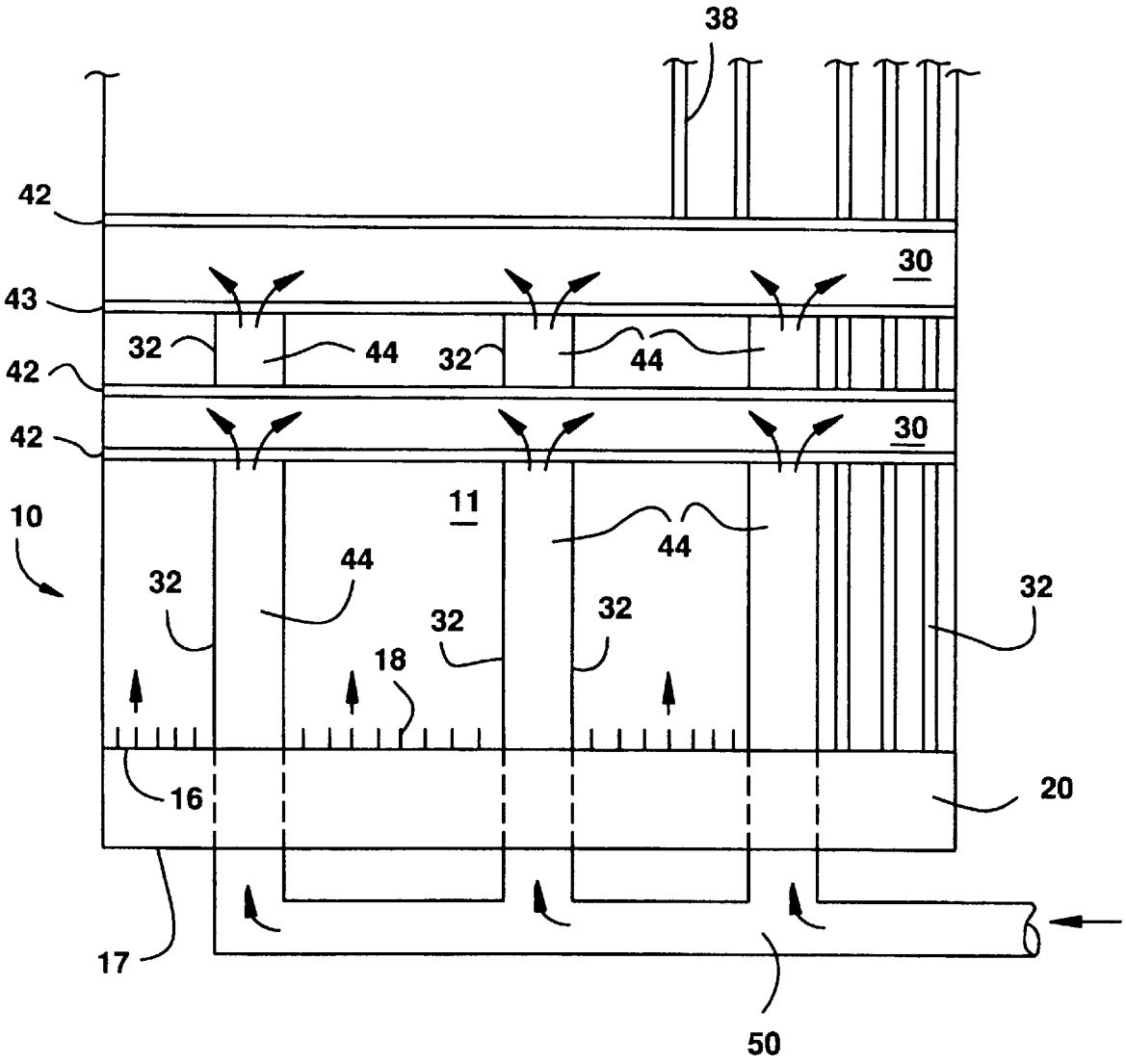
FIG. 7 is a sectional view of the plural secondary air plenum embodiment of FIG. 5, taken along line 7—7 of FIG. 3.

FIGS. 5–7 illustrate another aspect of the present invention wherein plural secondary air plenums 30 would be provided. Reference numerals are used as before. As shown in FIG. 7, the intermediate air feed ducts 44 extend upwardly through the furnace reactor enclosure 11 to provide the secondary air to each plenum 30. Headers 42, 43 may or may not be provided at the lower and upper ends of each of the plenums 30 as the case may be. Secondary air is preferably provided to the intermediate air feed ducts 44 via inlet plenum 50 as shown, and short extensions of the intermediate air feed ducts 44 from the lower plenum 30 would provide the secondary air to the upper plenum 30. FIG. 7 also illustrates how the intermediate feed ducts 44 would be arranged for the embodiment of FIG. 5; one need only ignore the upper plenum 30 and the short extensions of the intermediate air feed ducts 44 to visualize same.

Figure 8:
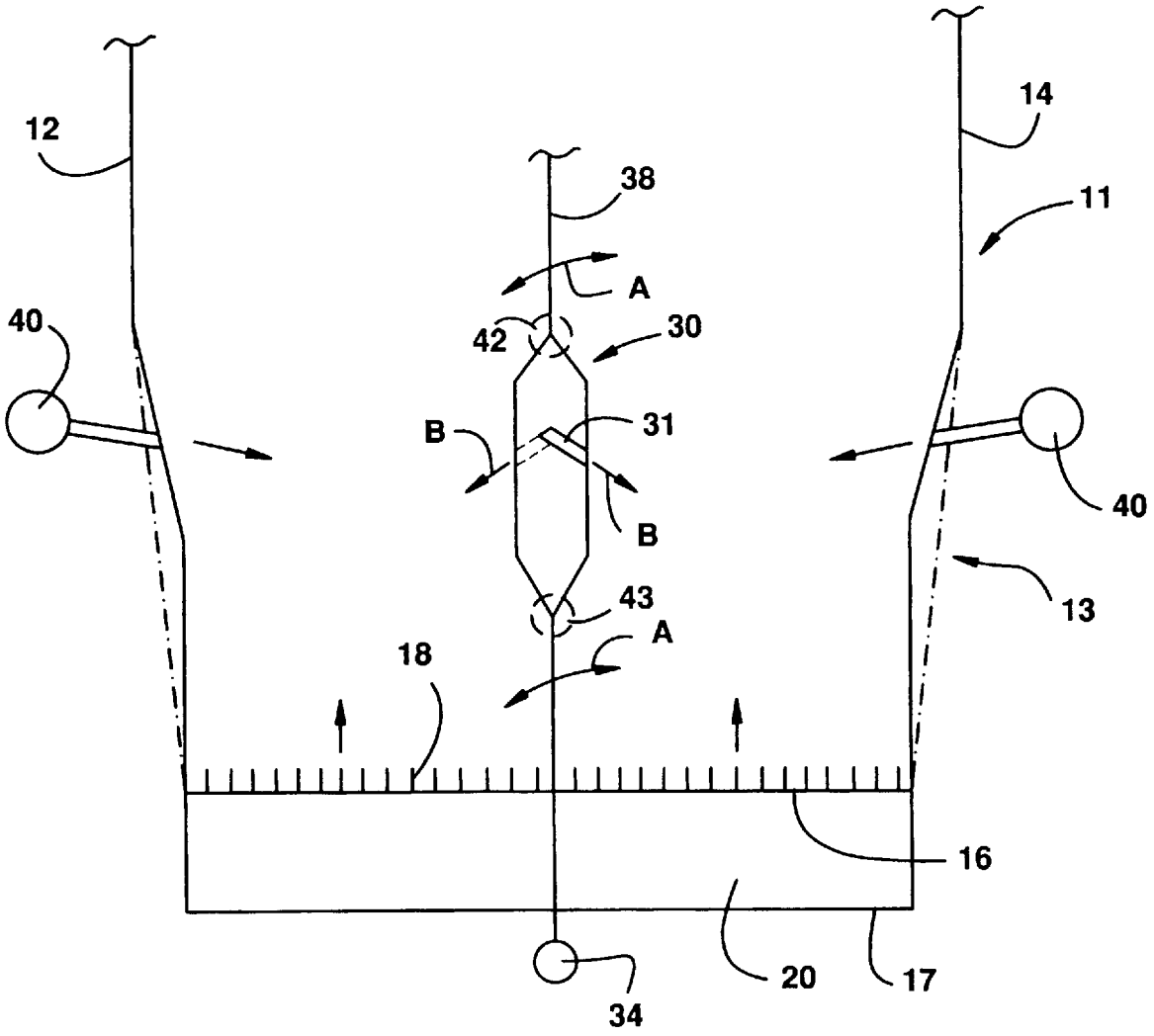
FIG. 8 is a schematic sectional side view similar to FIG. 1 of a still further embodiment of the invention.

FIG. 8 shows another embodiment of the invention where the front and rear walls 12, 14 of the furnace reactor enclosure 11 can be angled inwardly so that the lower portion of the furnace reactor enclosure 11 is smaller than the upper portion. This variation can be used if it is necessary to change the circulating fluidized bed dynamics. A further wall configuration alternative is shown by dotted lines at 13.

Figure 9:
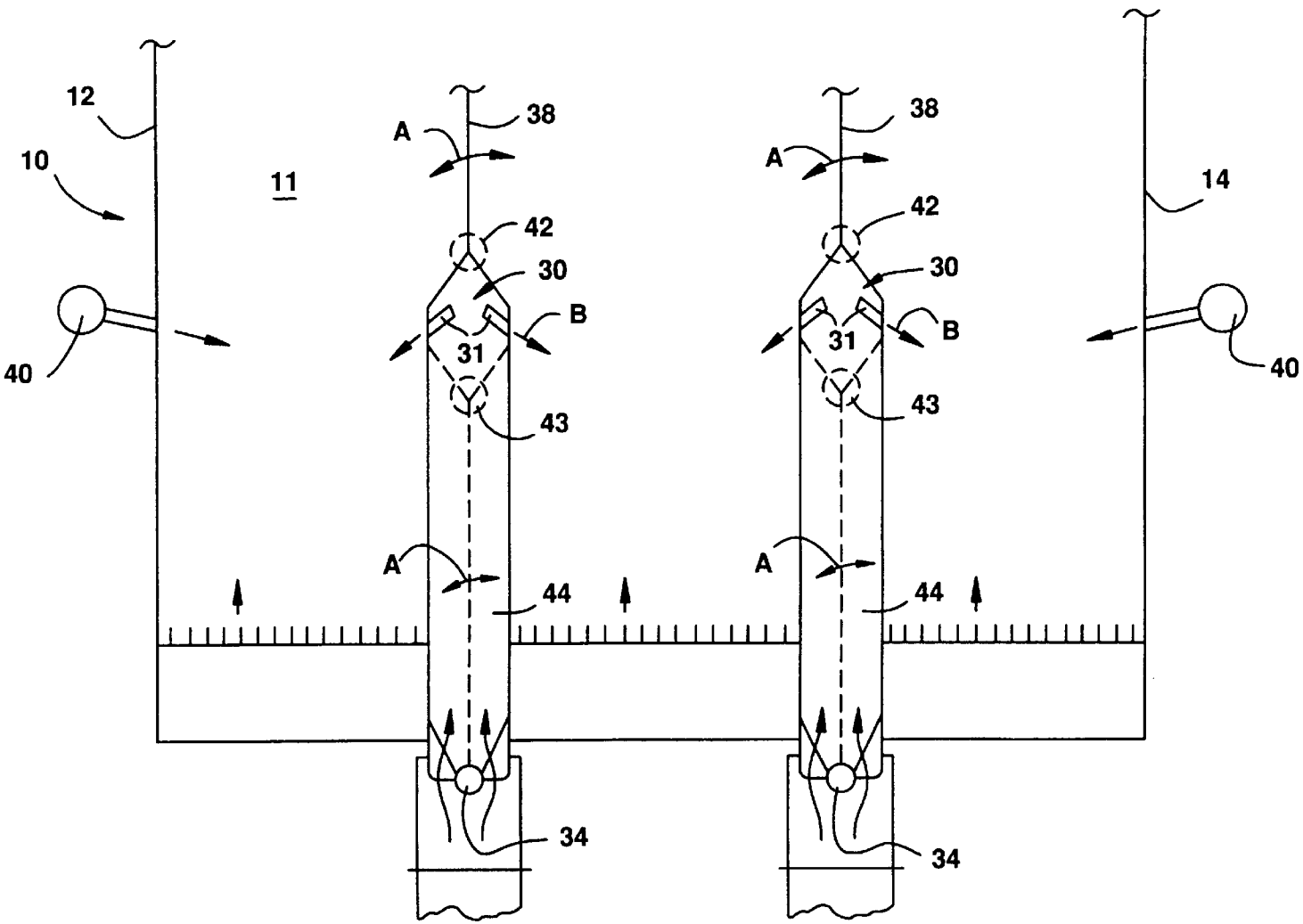
FIG. 9 is a schematic sectional side view similar to FIG. 5 of a still further embodiment of the invention, wherein plural secondary air plenums are employed side-by-side.
Figure 10:
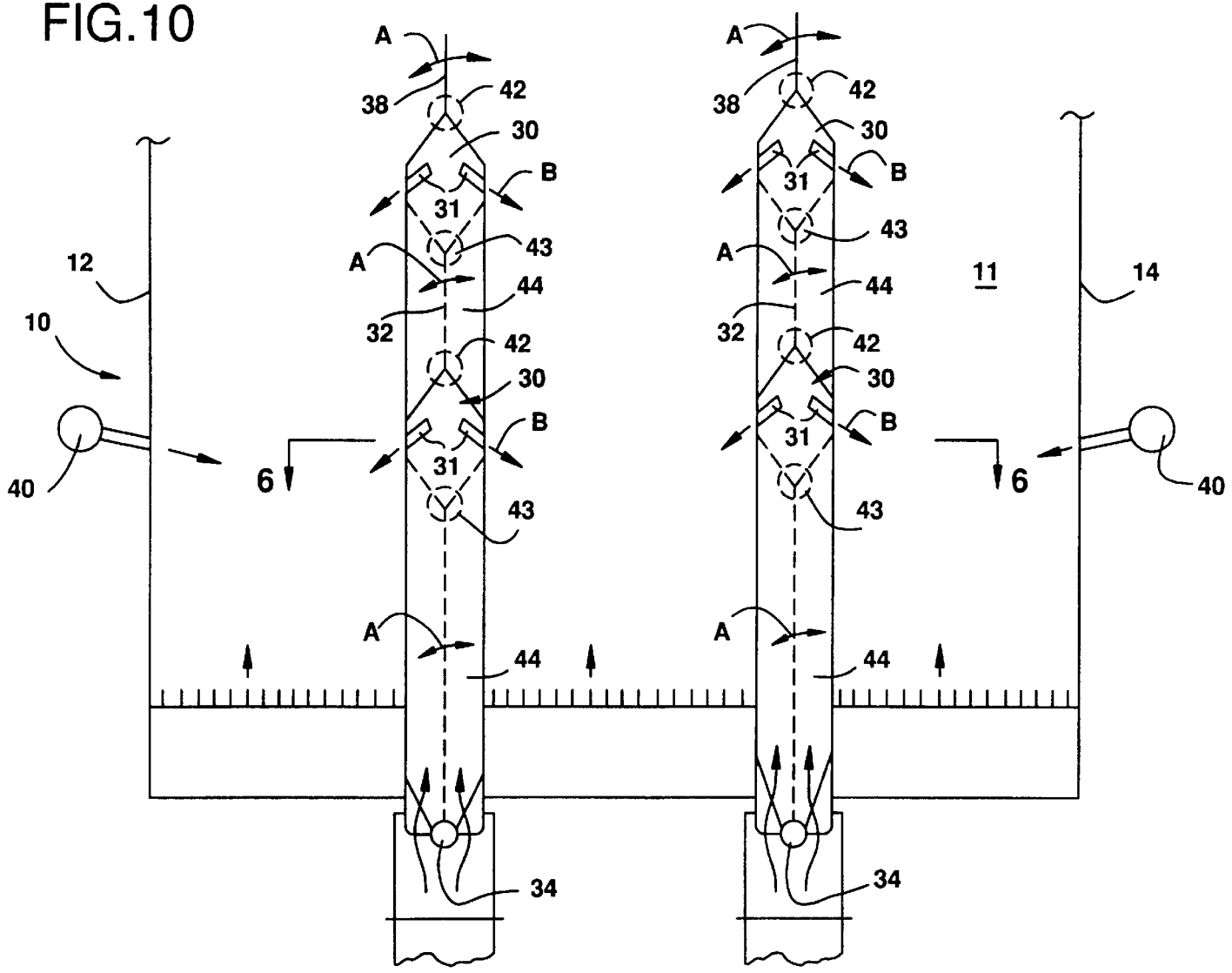
FIG. 10 is a schematic sectional side view similar to FIG. 5 of a still further embodiment of the invention, wherein plural pairs of secondary air plenums are employed side-by-side.

Finally, FIGS. 9 and 10 illustrate still further embodiments wherein the concept of the integral secondary air plenum of the present invention can be employed in even larger and deeper CFB reactor constructions. FIG. 9 is a variation and combination of the embodiments of FIGS. 3 and 5. As shown in FIG. 9, plural integral secondary air plenums 30 can be provided, side-by-side, instead of being located one above the other as in FIG. 5. Each integral secondary air plenum 30 is supplied with secondary air via its own set of independent intermediate air feed ducts 44. Similarly, FIG. 10 is a variation of FIG. 5, and illustrates that it might also be possible to provide plural pairs of integral secondary air plenums 30, side-by-side, each pair comprising a lower and an upper integral secondary air plenum 30. Again, as in the case of FIG. 5, the lower integral secondary air plenum 30 in each pair would be fed air via intermediate air feed ducts 44, and the upper integral secondary air plenum 30 in each pair would be supplied air via the aforementioned short intermediate air feed duct extensions 44 connected to the lower integral secondary air plenum, as shown and described in connection with FIG. 7.

While specific embodiments of the invention have been shown and described in detail to illustrate the application of the principles of the invention, it will be understood that the invention may be embodied otherwise without departing from such principles.

We claim:

1. A circulating fluidized bed reactor, comprising:

a furnace reactor enclosure at least partially defined by a front wall and a rear wall spaced away from the front wall, and a bottom wall connected between the front and rear walls;

means for supplying primary air through the bottom wall for fluidizing a circulating bed in the furnace reactor enclosure;

means for recirculating the bed from a top of the furnace reactor enclosure back to a lower portion thereof; and waterwall means for defining at least one integral secondary air plenum in the furnace reactor enclosure for supplying secondary air into the fluidized bed, above the bottom wall, without physically separating a lower or an upper portion of the furnace reactor enclosure into portions, said waterwall means extending substantially vertically in the furnace reactor enclosure and having a plurality of openings therethrough to allow for good communication of gases and solids therethrough from one side of the waterwall means to the other between front and rear portions of the furnace reactor enclosure at both the upper and lower portions thereof.

2. The reactor according to claim 1 wherein the furnace reactor enclosure includes side walls, the at least one integral secondary air plenum extending between the side walls.

3. The reactor according to claim 2 including vertically extending intermediate air feed ducts communicating with the at least one integral secondary air plenum from the bottom of the enclosure.

4. The reactor according to claim 1 wherein the cross section of the at least one integral secondary air plenum and the cross section of the intermediate air feed ducts is selected from the shapes comprising square, rectangular, oval, circular, elliptical and diamond shaped.

5. The reactor according to claim 1 wherein the means for defining at least one integral secondary air plenum in the furnace reactor enclosure for supplying secondary air into the fluidized bed, above the bottom wall, comprises plural integral secondary air plenums and intermediate air feed ducts communicating with the integral secondary air plenums.

6. The reactor according to claim 5, wherein the plural integral secondary air plenums are located one above the other.

7. The reactor according to claim 5, wherein the plural integral secondary air plenums are located side-by-side.

8. The reactor according to claim 1 wherein the means for defining at least one integral secondary air plenum in the furnace reactor enclosure for supplying secondary air into the fluidized bed, above the bottom wall, comprises plural pairs of integral secondary air plenums and intermediate air feed ducts communicating with at least one of the integral secondary air plenums in each pair.

9. The reactor according to claim 8, wherein the integral secondary air plenums in each of the plural pairs are located one above the other.

* * * * *